US010626517B2

(12) United States Patent
Zeng

(10) Patent No.: US 10,626,517 B2
(45) Date of Patent: Apr. 21, 2020

(54) ALUMINUM ALLOY AND METHOD OF ANODIZING SAME

(71) Applicant: GUANGDONG OPPO MOBILE TELECOMMUNICATIONS CORP., LTD., Dongguan, Guangdong (CN)

(72) Inventor: Yuanqing Zeng, Dongguan (CN)

(73) Assignee: GUANGDONG OPPO MOBILE TELECOMMUNICATIONS CORP., LT, Dongguan (CN)

( * ) Notice: Subject to any disclaimer, the term of this patent is extended or adjusted under 35 U.S.C. 154(b) by 152 days.

(21) Appl. No.: 15/521,992

(22) PCT Filed: Apr. 8, 2016

(86) PCT No.: PCT/CN2016/078814

§ 371 (c)(1),
(2) Date: Apr. 26, 2017

(87) PCT Pub. No.: WO2016/161964

PCT Pub. Date: Oct. 13, 2016

(65) Prior Publication Data

US 2017/0327964 A1 Nov. 16, 2017

(30) Foreign Application Priority Data

Apr. 9, 2015 (CN) ..... 2015 1 0166276

(51) Int. Cl.
*C25D 5/50* (2006.01)
*C25D 11/04* (2006.01)
(Continued)

(52) U.S. Cl.
CPC ..... *C25D 11/16* (2013.01); *B08B 3/08* (2013.01); *B08B 3/10* (2013.01); *C22C 21/10* (2013.01);
(Continued)

(58) Field of Classification Search
CPC ..... C23C 28/00; C25D 5/50; C25D 11/04; C25D 11/16; C25D 11/18
(Continued)

(56) References Cited

U.S. PATENT DOCUMENTS 4,672,506 A 6/1987 Deguchi et al.
5,834,148 A * 11/1998 Murayama ..... G03G 5/102 430/69
(Continued)

FOREIGN PATENT DOCUMENTS

CN 101665969 A 3/2010
CN 102649209 A 8/2012
(Continued)

OTHER PUBLICATIONS

Kumar et al., "Studies on White Anodizing on Aluminum Alloy for Space Applications," Applied Surface Science (1999), vol. 151, pp. 280-286. (Year: 1999).*
(Continued)

*Primary Examiner* — Edna Wong

(57) ABSTRACT

An aluminum alloy is described and has compositions with mass percentage content consisting of: 5.0%-5.4% Zn; 0.9%-1.2% Mg; Cu<0.05%; Si<0.05%; Fe<0.1%; Mn<0.05%; Zr<0.1%; Ti<0.05%; other impurities <0.15%; and the remaining composition being Al. An anodizing method of the aluminum alloy described above is described and has: a degreasing treatment, a first black-film stripping treatment, a chemical polishing treatment, a second black-film stripping treatment, an anodizing treatment, a hole filling treatment and a drying treatment which are performed in turn. The aluminum alloy has a higher strength while eliminating an influence of a formed compound phase on a material texture.

15 Claims, 2 Drawing Sheets

(51) Int. Cl.

| | |
|---|---|
| ***C25D 11/16*** | (2006.01) |
| ***C25D 11/18*** | (2006.01) |
| ***C23C 28/00*** | (2006.01) |
| ***C22C 21/10*** | (2006.01) |
| ***C23F 3/03*** | (2006.01) |
| ***B08B 3/08*** | (2006.01) |
| ***B08B 3/10*** | (2006.01) |
| ***C25D 11/08*** | (2006.01) |

(52) U.S. Cl.
CPC ..... *C23F 3/03* (2013.01); *C25D 11/08* (2013.01); *C25D 11/18* (2013.01)

(58) Field of Classification Search
USPC ..... 205/201, 203, 213, 224, 325
See application file for complete search history.

(56) References Cited

U.S. PATENT DOCUMENTS

| | | | | |
|---|---|---|---|---|
| 2008/0173378 | A1 | 7/2008 | Khosla et al. | |
| 2009/0053098 | A1 | 2/2009 | Yoshida | |
| 2010/0051467 | A1 | 3/2010 | Tian et al. | |
| 2011/0017366 | A1 | 1/2011 | Yoshida et al. | |
| 2013/0270120 | A1* | 10/2013 | Yao | C25D 11/16 205/50 |
| 2015/0090373 | A1 | 4/2015 | Gable et al. | |

FOREIGN PATENT DOCUMENTS

| | | | | | |
|---|---|---|---|---|---|
| CN | 102888644 | A | * | 1/2013 | C25D 11/14 |
| CN | 102888644 | A | | 1/2013 | |
| CN | 103643235 | A | * | 3/2014 | C23F 17/00 |
| CN | 103643235 | A | | 3/2014 | |
| CN | 104278178 | A | | 1/2015 | |
| CN | 104762538 | A | | 7/2015 | |
| EP | 2141253 | A1 | | 1/2010 | |
| JP | S59113164 | A | | 6/1984 | |
| JP | 4753240 | B2 | | 8/2011 | |
| JP | 5023233 | B1 | * | 9/2012 | C22C 21/10 |
| WO | 2008003506 | A2 | | 1/2008 | |

OTHER PUBLICATIONS

Khobaib et al., "Inhibition of Corrosion Fatigue in High Strength Aluminum Alloys," Corrosion (May 1981), vol. 36, No. 5, pp. 285-292. (Year: 1981).*

Keller et al., "Conditioning Aluminum Alloys for Electroplating," Journal of the Electrochemical Society (Apr. 1950), vol. 97, No. 4, pp. 143-151. (Year: 1950).*

Stevenson, Jr., "Anodizing," ASM Handbook (© 1994), vol. 5: Surface Engineering, pp. 482-493. (Year: 1994).*

Stevenson, M. F, Jr. Anodizing, Surface Engineering. vol. 5.ASM Handbook, ASM International, 1994, p. 482-493, (Year: 1994).

Supplementary European Search Report in European application number: 16776139.4, dated Nov. 24, 2017.

General Administration of Quality Supervision, Inspection and Quarantine of the People's Republic of China/Standardization Administration of the People's Republic of China; Series 7; Chinese national standards GB/T3190-2008 Wrought Aluminium and Aluminium Alloy-Chemical Composition; Jun. 17, 2008; p. 13-14.

Wang Xu;Wu Si;Liu Yun-Teng;Li Wei-Hong;Zhou Ji-Xue;Tang Shou-Qiu; Research advances of microalloying Al—Zn—Mg-( Cu) series aluminum alloy; Shangdong Science; Feb. 15, 2014; p. 56-p. 62; vol. 17, No. 1.

Li, Chao et al.; Effect of Zn/Mg Ratio on Microstructure Evolution of Aluminum Alloy 7085 During Aging; Hot Working Technology; Feb. 25, 2013; p. 215-218, 222; vol. 42, No. 4.

Jia, Pei-Tai et al., Grades, Chemical Composition and Product Type of Deforming Aluminum and Aluminum Alloy ; Domestic and Foreign Metal Materials Manual; Jan. 31, 2005; p. 1261; V2.

Xiao, Yaqing et al.; Aluminum Alloy of Series 7; Handbook of Aluminum Processing Technology; Jan. 31, 2005; p. 176-177.

ISR mailed Jul. 14, 2016; PCT/CN2016/078814.

* cited by examiner

ALUMINUM ALLOY AND METHOD OF ANODIZING SAME

CROSS REFERENCE TO RELATED APPLICATION

This application is an International Application No. PCT/CN2016/078814, filed on Apr. 8, 2016, which claims priority to Chinese Application No. 201510166276.1, filed on Apr. 9, 2015. The entire disclosures of the above applications are incorporated herein by reference.

FIELD OF THE DISCLOSURE

The present disclosure relates to an aluminum alloy, and more particularly to an aluminum alloy and a method of anodizing same.

BACKGROUND OF THE DISCLOSURE

In conventional anodizing technology, series 5 and series 6 aluminum alloys are usually anodized for protecting a surface of aluminum material thereof. However, due to compositions of the series 5 and series 6 aluminum alloys, the series 5 and series 6 aluminum alloys have a relatively low material strength and there are many restrictions on structural designs thereof. The high strength aluminum alloy of series 7 has a high strength. However, in conventional technology, other surface treatments, such as an electrophoresis, etc. are generally used on the series 7 high strength aluminum alloy. If the anodization is performed on the series 7 high strength aluminum alloy, a material texture is easily formed on a surface of the series 7 high strength aluminum alloy whereby a surficial brightness capability thereof is not good enough.

SUMMARY OF THE DISCLOSURE

An object of an embodiment of the present disclosure is to overcome the above-mentioned drawbacks of conventional technologies and to provide an aluminum alloy which can have a high strength and a relatively good brightness simultaneously.

Another object of an embodiment of the present disclosure is to overcome the above-mentioned drawbacks of the conventional technologies and to provide an anodizing method of an aluminum alloy which can obtain the aluminum alloy with a high strength and a relatively good brightness simultaneously.

To achieve the above object of the embodiment of the present disclosure, a technical solution of the present disclosure is as follows:

An aluminum alloy comprises compositions with mass percentage content consisting of 5.0%-5.4% Zn; 0.9%-1.2% Mg; Cu<0.05%; Si<0.05%; Fe<0.1%; Mn<0.05%; Zr<0.1%; Ti<0.05%; other impurities <0.15%; and the remaining composition being Al.

An anodizing method of an aluminum alloy comprises: a degreasing treatment, a first black-film stripping treatment, a chemical polishing treatment, a second black-film stripping treatment, an anodizing treatment, a hole filling treatment and a drying treatment which are performed in turn.

An aluminum alloy provided by an embodiment of the present disclosure has a higher strength while eliminating an influence of compound phases formed on a material texture thereof An anodizing method of an aluminum alloy provided by an embodiment of the present disclosure enables the aluminum alloy not to exhibit a material texture on a surface thereof, to have a good surface brightness and to have a relatively high strength.

DETAILED DESCRIPTION OF THE PREFERRED EMBODIMENTS

The present disclosure will now be described in further detail with reference to the accompanying drawings and examples to make the objects, technical solutions and advantages of the present disclosure more clearly understood. It is to be understood that the specific embodiments described herein are merely illustrative of the present disclosure and are not intended to limit the present disclosure.

The present disclosure provides an aluminum alloy comprising compositions with mass percentage content consisting of: 5.0%-5.4% Zn; 0.9%-1.2% Mg; Cu<0.05%; Si<0.05%; Fe<0.1%; Mn<0.05%; Zr<0.1%; Ti<0.05%; other impurities <0.15%; and remaining composition being Al.

Preferably, the aluminum alloy comprising compositions with mass percentage content consisting of: 5.15%-5.197% Zn; 0.900%-0.980% Mg; Cu<0.0015%; Si<0.0464%; Fe<0.0990%; Mn<0.0019%; Zr<0.1%; Ti<0.028%; other impurities <0.15%; and the remaining composition being Al.

Figure 1:
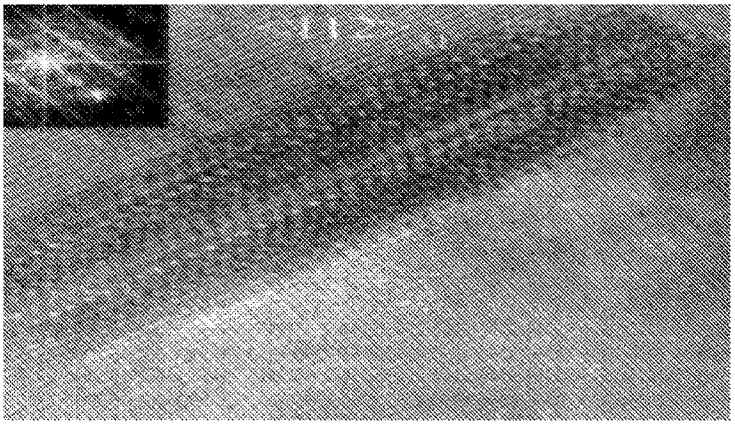
FIG. 1 is a surface-viewing schematic diagram of a AlZnMgCu strengthening phase.

The aluminum alloy of the present disclosure is an aluminum alloy material which is mainly AlZnMg. Strengthening phases in the aluminum alloy are mainly an $Zn_2Mg$ phase and an AlZnMgCu phase and two of which form different strengthening regions. However, the strengthening region formed by the AlZnMgCu phase in the alloy expresses a serious material texture in an anodizing process, or becomes an aluminum squeeze pattern, as shown in FIG. 1. Therefore, the AlZnMgCu content should be controlled as restrictedly as possible to achieve an effect with a relatively good brightness. Further, the copper content is lower, and an anodizing effect is better. If the copper content is high, the material texture will appear after anodizing. Therefore, the present disclosure controls the copper content to be <0.05%. In addition, a metal compound formed by Si, Fe and Mn together with Al makes a gray oxide film. Therefore, the present disclosure controls the SI content to be <0.05%, the Fe content to be <0.1% and the Mn content to be <0.05%. Based on the above description, the $Zn_2Mg$ strengthening phase should be formed in the aluminum alloy of the present disclosure as much as possible. The choices of Zn and Mg content can be chosen by an atomic ratio of $Zn_2Mg$, and a mass ratio of Zn and Mg can be determined by a formula $65\times2/24=5.4$. Therefore, the mass ratio of Zn and Mg can be controlled between 5 and 6. Preferably, the mass ratio of Zn and Mg is 5.4. Through the design of the above compositions, the aluminum alloy of the present disclosure has a higher strength while eliminating an influence of the other compound phase on the material texture.

The present disclosure further provides an anodizing method of an aluminum alloy comprises: a degreasing treatment, a first black-film stripping treatment, a chemical polishing treatment, a second black-film stripping treatment, an anodizing treatment, a hole filling treatment and a drying treatment which are performed in turn.

The method may further comprises a sandblasting treatment prior to the degreasing treatment. In the sandblasting treatment, 150 # zirconium sand with a density of 2.5 kg/cm$^2$ can be selected. To compare the aluminum alloy processed by an anodization after the sandblasting treatment with an aluminum alloy directly processed by an anodization without a sandblasting treatment, a surface of the sandblasted aluminum alloy has a matte color, but a surface of the aluminum alloy without the sandblasting treatment has a glare. Therefore, the sandblasting treatment can be chosen or not according to the specific requirements of the appearance.

In the degreasing treatment, the degreasing treatment is performed using trisodium phosphate in an alkaline condition. The degreasing treatment is performed at a temperature ranging from 50 to 60° C. and a time ranging from 2 to 4 minutes. Preferably, the degreasing treatment is performed at a temperature of 55° C. and a time of 3 minutes.

In the first black-film stripping treatment and the second black-film stripping treatment, the black film is stripped using nitric acid. These black-film stripping treatments are performed at a room temperature and a time ranging from 30 to 90 s. Preferably, the time is 1 minute.

In the chemical polishing treatment, a pure phosphoric acid is used as a polishing agent, which has a specific gravity from 1.69-1.71 g/mL. The chemical polishing treatment is performed at a temperature ranging from 100 to 110° C., preferably 100° C., and a time ranging from 7 to 15 s. The chemical polishing can improve the brightness of the surface of the aluminum alloy. The longer the chemical polishing time, the more chemical corrosion and the better the brightness. However, since the material texture is first formed in the interior of the aluminum alloy material, therefore the chemical corrosion increases with the increase of the chemical polishing time, and an internal material texture is presented with the corrosion loss of the material on the surface of the aluminum alloy. Therefore, it is necessary to select an appropriate chemical polishing time according to the brightness before the chemical polishing and the depth of the material texture. When the brightness of the surface of the aluminum alloy before the chemical polishing is relatively high, the chemical polishing is performed at a relatively short time. The shortest time of the chemical polishing is 7 seconds, which is determined by the inventor of the present disclosure via repeated experiments, so as to meet the requirements of high surface brightness and no material texture. When the brightness of the surface of the aluminum alloy before the chemical polishing is relatively low, the chemical polishing time can be extended. The longest time of the chemical polishing is 15 seconds, which is determined by the inventor of the present disclosure via repeated experiments. If the time is more than 15 seconds, the surface of the aluminum appears a material texture in line shape. Through the chemical polishing, the gloss of the surface of the aluminum alloy ranges from 45 to 50.

In the anodizing treatment, an oxidant being sulfuric acid is used at a concentration ranging from 200 to 220 g/L. The anodizing treatment is performed at a temperature ranging from 18 to 20° C., a voltage ranging from 8 to 10V and a time ranging from 40 to 50 min. The larger the anodic oxidation voltage, the larger the membrane pore and the greater the direction of its crystal orientation, resulting in the more serious material texture. Therefore, the voltage of the anodization controlled from 8 to 10V can meet the effect of anodization and avoid the effect of material texture, simultaneously. A thickness of an anodized film has a certain effect on the appearance of the aluminum alloy. The thicker the oxide film, the greater the electrochemical effect of the anodization. The greater the corrosion of a layer inside the material, the more serious the material defects, such as the material texture and so on. Therefore, need to control the anodic oxidation of the film thickness. It is necessary to control the thickness of the anodized film. The inventor of the present disclosure, via repeated experiments, determines that the effect is the best when the thickness of the anodized film ranges from 8 to 10 um.

The longer the anodization, the greater the thickness of the film. In order to control the thickness of the anodized film to meet the above definition, the time for controlling the anodic oxidation treatment is set from 40 to 50 minutes. The technical solution of the present disclosure will be further described below with reference to specific examples.

Embodiment 1

An aluminum alloy of Embodiment 1 comprises: compositions with mass percentage content consisting of: Zn: 5.0%; Mg: 0.9%; Cu: 0.0018%; Si: 0.021%; Fe: 0.0649%; Mn: 0.008%; Zr: 0.0034%; Ti: 0.02%; other impurities: 0.09%; and the remaining being Al.

An anodizing method of the aluminum alloy comprises: a degreasing treatment, a first black-film stripping treatment, a chemical polishing treatment, a second black-film stripping treatment, an anodizing treatment, a hole filling treatment and a drying treatment which are performed in turn.

Wherein the degreasing treatment is performed using trisodium phosphate in an alkaline condition for degreasing. The degreasing treatment is performed at a temperature of 55° C. and a time of 3 min. In the first black-film stripping treatment, the black film is stripped using nitric acid. The black-film stripping treatment is performed at a room temperature and a time is 1 min. A pure phosphoric acid of the chemical polishing treatment is used as a polishing agent, which has a specific gravity from 1.69-1.71 g/mL. The chemical polishing treatment is performed at a temperature of 100 and a time of 15 s. A surface of the chemical-polished aluminum alloy has a gloss of 45. In the second black-film stripping treatment, the black film is stripped using nitric acid. The black-film stripping treatment is performed at a room temperature and a time is 1 min. In the anodizing treatment, an oxidant is sulfuric acid at a concentration of 220 g/L. The anodizing treatment is performed at a temperature of 18° C., a voltage of 8V and a time of 50 min. A thickness of the anodizing-treated film is 10 um.

Figure 2:
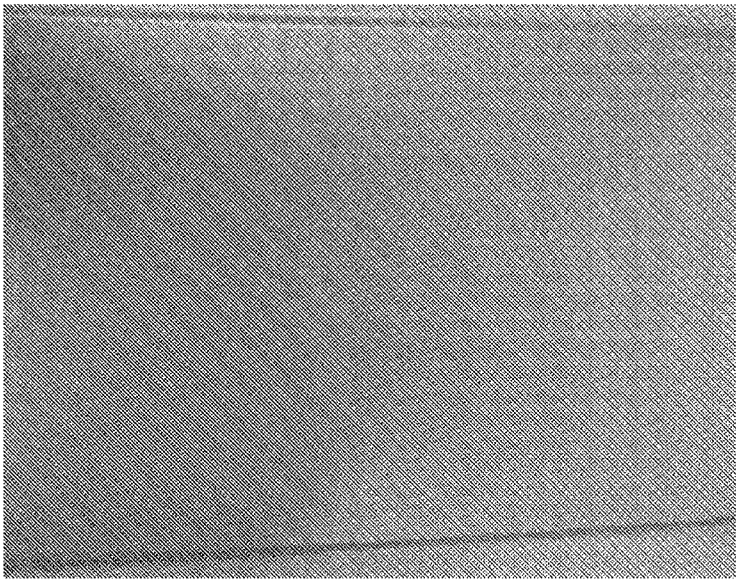
FIG. 2 is a surface effect diagram of an anodized aluminum alloy of Embodiment 1 of the present disclosure.

The anodized aluminum alloy has mechanical property results as follows: the aluminum alloy can have a hardness achieving 120 HV, and a tensile strength of 350 Mpa by using a national standard test of the material. A surface effect of the anodized aluminum alloy is shown in FIG. 2. It can be seen from FIG. 2 that the anodized aluminum alloy has a good surface brightness and no material texture.

Embodiment 2

An aluminum alloy of Embodiment 2 comprises: compositions with mass percentage content consisting of: Zn: 5.2%; Mg: 1.0%; Cu: 0.002%; Si: 0.031%; Fe: 0.0035%; Mn: 0.012%; Zr: 0.0051%; TI: 0.024%; other impurities: 0.07%; and the remaining being Al.

An anodizing method of the aluminum alloy comprises: a degreasing treatment, a first black-film stripping treatment, a chemical polishing treatment, a second black-film stripping treatment, an anodizing treatment, a hole filling treatment and a drying treatment which are performed in turn.

Wherein the degreasing treatment is performed using trisodium phosphate in an alkaline condition for degreasing. The degreasing treatment is performed at a temperature of 50° C. and a time of 4 min. In the first black-film stripping treatment, the black film is stripped using nitric acid. The black-film stripping treatment is performed at a room temperature and a time is 30 s. A pure phosphoric acid of the chemical polishing treatment is used as a polishing agent, which has a specific gravity from 1.69-1.71 g/mL. The chemical polishing treatment is performed at a temperature of 105° C. and a time of 11 s. A surface of the chemical-polished aluminum alloy has a gloss of 50. In the second black-film stripping treatment, the black film is stripped using nitric acid. The black-film stripping treatment is performed at a room temperature and a time is 30 s. In the anodizing treatment, an oxidant is sulfuric acid at a concentration of 200 g/L. The anodizing treatment is performed at a temperature of 19° C., a voltage of 9V and a time of 45 minutes. A thickness of the anodizing-treated film is 9.8 um.

Figure 3:
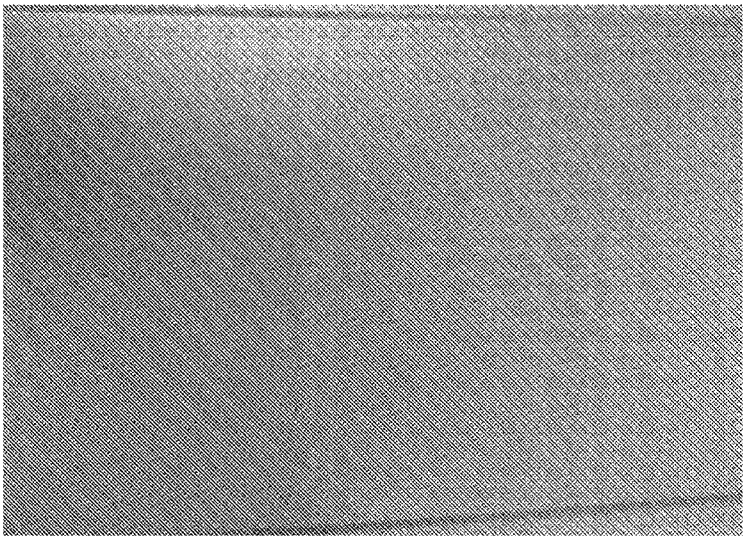
FIG. 3 is a surface effect diagram of an anodized aluminum alloy of Embodiment 2 of the present disclosure.

The anodized aluminum alloy has mechanical property results as follows: the aluminum alloy can have a hardness achieving 116 HV, and a tensile strength of 340 Mpa by using a national standard test of the material. A surface effect of the anodized aluminum alloy is shown in FIG. 3. It can be seen from FIG. 3 that the anodized aluminum alloy has a good surface brightness and no material texture.

Embodiment 3

An aluminum alloy of Embodiment 3 comprises: compositions with mass percentage content consisting of: Zn: 5.4%; Mg: 1.2%; Cu: 0.0015%; Si: 0.0318%; Fe: 0.049%; Mn: 0.008%; Zr: 0.0034%; Ti: 0.02%; other impurities: 0.09%; and the remaining being Al.

An anodizing method of the aluminum alloy comprises: a degreasing treatment, a first black-film stripping treatment, a chemical polishing treatment, a second black-film stripping treatment, an anodizing treatment, a hole filling treatment and a drying treatment which are performed in turn.

The degreasing treatment is performed using trisodium phosphate in an alkaline condition for degreasing. The degreasing treatment is performed at a temperature of 60° C. and a time of 2 min. In the first black-film stripping treatment, the black film is stripped using nitric acid. The black-film stripping treatment is performed at a room temperature and a time is 90 s. A pure phosphoric acid of the chemical polishing treatment is used as a polishing agent, which has a specific gravity from 1.69-1.71 g/mL. The chemical polishing treatment is performed at a temperature of 115° C. and a time of 8 s. A surface of the chemical-polished aluminum alloy has a gloss of 45. In the second black-film stripping treatment, the black film is stripped using nitric acid. The black-film stripping treatment is performed at a room temperature and a time is 90 s. In the anodizing treatment, an oxidant is sulfuric acid at a concentration of 220 g/L. The anodizing treatment is performed at a temperature of 20° C., a voltage of 10V and a time of 40 min. A thickness of the anodizing-treated film is 8 um.

Figure 4:
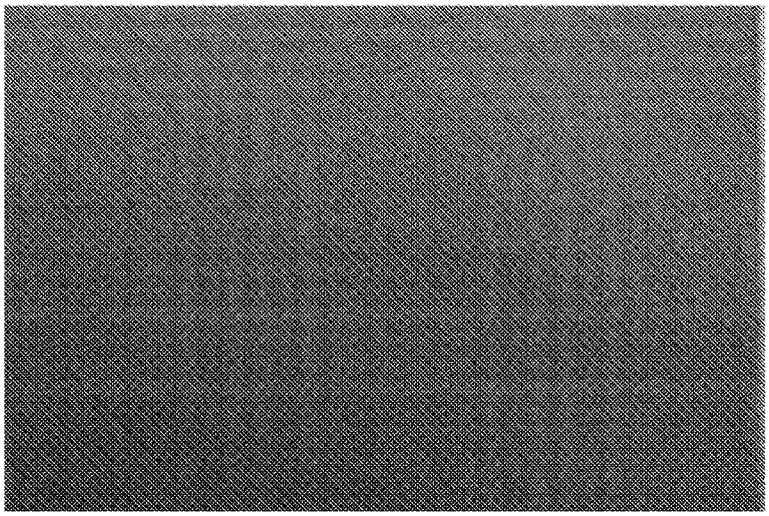
FIG. 4 is a surface effect diagram of an anodized aluminum alloy of Embodiment 3 of the present disclosure.

The anodized aluminum alloy has mechanical property results as follows: the aluminum alloy can have a hardness achieving 110 HV, and a tensile strength of 334 Mpa by using a national standard test of the material. A surface effect of the anodized aluminum alloy is shown in FIG. 4. It can be seen from FIG. 4 that the anodized aluminum alloy has a good surface brightness and no material texture.

The description above is Intended only as a preferred embodiment of the present disclosure and is not intended to be limiting of the present disclosure. Any modifications, equivalent substitutions and improvements within the spirit and principles of the present disclosure are intended to be included within the scope of the present disclosure.

What is claimed is:

1. An anodizing method of an aluminum alloy, comprising: performing a degreasing treatment, a first black-film stripping treatment, a chemical polishing treatment, a second black-film stripping treatment, an anodizing treatment, a hole filling treatment and a drying treatment on the aluminum alloy in turn, wherein the aluminum alloy comprises compositions with mass percentage content consisting of: 5.0%-5.4% Zn; 0.9%-1.2% Mg; Cu<0.05%; Si<0.05%; Fe<0.1%; Mn<0.05%; Zr<0.1%; Ti<0.05%; other impurities <0.15%; and a remaining composition being Al, a mass ratio of Zn and Mg is 5.4, wherein the degreasing treatment is performed using trisodium phosphate, at a temperature ranging from 50° C. to 60° C. and a time ranging from 2 mins to 4 mins, in the chemical polishing treatment, a pure phosphoric acid is used as a polishing agent, which has a specific gravity from 1.69-1.71 g/mL, and wherein the aluminum alloy after anodizing has no material texture on a surface thereof.

2. The anodizing method of the aluminum alloy according to claim 1, wherein the anodizing treatment is performed at a temperature ranging from 18° C. to 20° C., a voltage ranging from 8V to 10V and a time ranging from 40 mins to 50 mins, and a film thickness after the anodizing treatment ranges from 8 to 10 um.

3. The anodizing method of the aluminum alloy according to claim 2, further comprising: a sandblasting treatment prior to the degreasing treatment.

4. The anodizing method of the aluminum alloy according to claim 1, wherein the chemical polishing treatment is performed at a temperature ranging from 100° C. to 110° C. and a time ranging from 7 seconds to 15 seconds.

5. The anodizing method of the aluminum alloy according to claim 4, further comprising: a sandblasting treatment prior to the degreasing treatment.

6. The anodizing method of the aluminum alloy according to claim 1, wherein the first black-film stripping treatment is performed at a room temperature and a time ranging from 30 seconds to 90 seconds, and the second black-film stripping treatment is performed at a room temperature and a time ranging from 30 seconds to 90 seconds.

7. The anodizing method of the aluminum alloy according to claim 6, further comprising: a sandblasting treatment prior to the degreasing treatment.

8. The anodizing method of the aluminum alloy according to claim 1, further comprising: a sandblasting treatment prior to the degreasing treatment.

9. The anodizing method of the aluminum alloy according to claim 1, wherein the compositions with mass percentage content are consisting of: 5.15%-5.197% Zn; 0.900%-0.980% Mg; Cu<0.0015%; Si<0.0464%; Fe<0.0990%; Mn<0.0019%; Zr<0.1%; Ti<0.028%; the other impurities <0.15%; and the remaining composition being Al.

10. The anodizing method of the aluminum alloy according to claim 9, wherein the anodizing treatment is performed at a temperature ranging from 18° C. to 20° C., a voltage ranging from 8V to 10V and a time ranging from 40 mins to 50 mins, and a film thickness after the anodizing treatment ranges from 8 to 10 um.

11. The anodizing method of the aluminum alloy according to claim 10, further comprising: a sandblasting treatment prior to the degreasing treatment.

12. The anodizing method of the aluminum alloy according to claim 9, wherein the chemical polishing treatment is performed at a temperature ranging from 100° C. to 110° C. and a time ranging from 7 seconds to 15 seconds.

13. The anodizing method of the aluminum alloy according to claim 12, further comprising: a sandblasting treatment prior to the degreasing treatment.

14. The anodizing method of the aluminum alloy according to claim 9, wherein the first black-film stripping treatment is performed at a room temperature and a time ranging from 30 seconds to 90 seconds, and the second black-film stripping treatment is performed at a room temperature and a time ranging from 30 seconds to 90 seconds.

15. The anodizing method of the aluminum alloy according to claim 9, further comprising: a sandblasting treatment prior to the degreasing treatment.

* * * * *